United States Patent [19]

Graves

[11] 4,141,187

[45] Feb. 27, 1979

[54] ROOFING AND SURFACING MATERIAL AND METHOD

[76] Inventor: Robert J. Graves, 6319 Lee Hwy., Arlington, Va. 22205

[21] Appl. No.: 763,733

[22] Filed: Jan. 28, 1977

[51] Int. Cl.[2] ..... H05B 3/34

[52] U.S. Cl. ..... 52/173 R; 52/309.3; 219/213

[58] Field of Search ..... 156/71; 428/95, 227; 52/309.1, 309.3, 173, 516, 746, 747, 17; 404/17, 18, 19, 20; 219/213

[56] References Cited

U.S. PATENT DOCUMENTS

| | | | |
|---|---|---|---|
| 2,925,831 | 2/1960 | Welty | 404/20 X |
| 3,047,701 | 7/1962 | Frungel | 404/17 |
| 3,070,568 | 12/1962 | Gessler | 404/17 |
| 3,082,121 | 3/1963 | Donaldson | 428/95 |
| 3,328,232 | 6/1967 | Dunn | 52/309.1 |
| 3,423,264 | 1/1969 | Miron | 156/71 |
| 3,483,664 | 12/1969 | Funk | 52/309.6 |
| 3,568,579 | 3/1971 | Hoad | 404/45 |
| 3,575,778 | 4/1971 | Wilcox | 428/95 |
| 3,712,845 | 1/1973 | Hartung | 52/309.3 |
| 3,900,102 | 8/1975 | Hurst | 52/516 |
| 3,900,656 | 8/1975 | Schmidt | 428/95 |

OTHER PUBLICATIONS

Adhesives Age, vol. 15, No. 7, pp. 40, 41, Jul. 1972.

Sweet's Architectural Catalog File 7.1 O.W., pp. 2–13, 1975.

*Primary Examiner*—John E. Murtagh

*Attorney, Agent, or Firm*—Richard L. Schwaab

[57] ABSTRACT

A roofing and surfacing material and method for applying such material is disclosed. The surfacing material comprises weather-resistant light-weight polymeric substrate and a membrane of water impermeable pressure-sensitive adhesive material adhered onto a suitable base. In the preferred embodiment, the present invention comprises a synthetic polymeric substrate of 0.05 to 0.75 pounds per square foot, a water impermeable pressure-sensitive membrane of epoxy adhesive, and optionally an electrical heating grid embedded in said epoxy membrane.

6 Claims, 5 Drawing Figures

FIG. 1
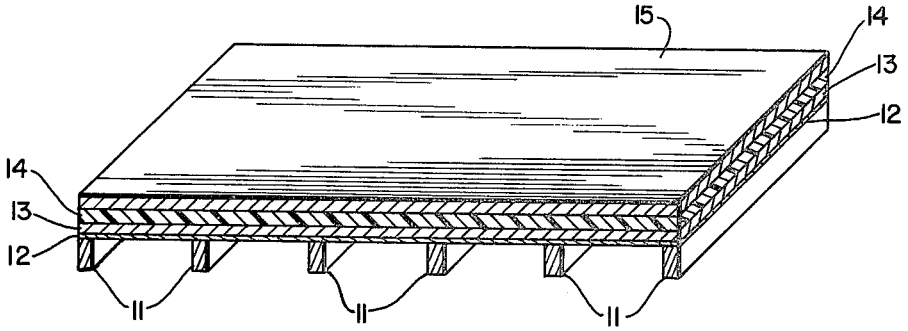
FIG. 2
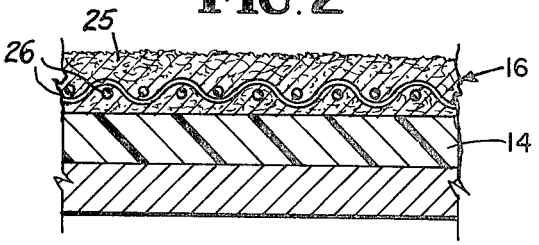
FIG. 3
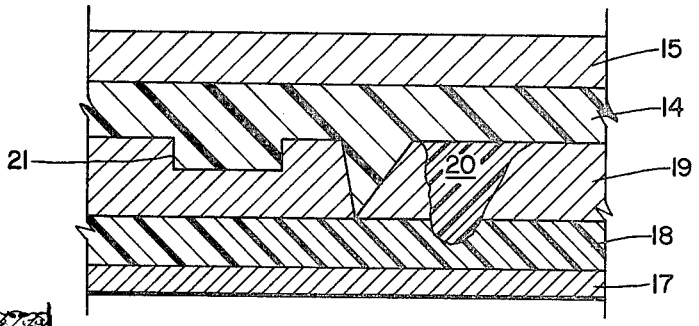
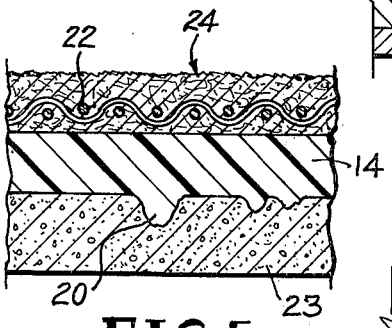
FIG. 5
FIG. 4
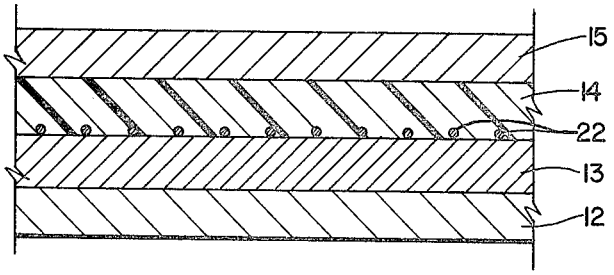

ROOFING AND SURFACING MATERIAL AND METHOD

BACKGROUND OF THE INVENTION (1 ) Field of the Invention

The present invention relates to a new light-weight roofing and surfacing material and a method for the application of such material. It is particularly concerned with a surfacing material comprising a water impermeable polymeric adhesive material as a base coat for adhering sheets of synthetic polymer substrate to a suitable surface. The instant invention finds application as a roofing material for providing either an original roof or for reroofing old structures. Additionally, the present invention may also be employed as a surfacing material for any concrete or other base, and provides a particularly efficacious method for repairing damaged concrete surfaces such as sidewalks, stairs, patios and driveways.

Even more particularly, the instant invention relates to the building of a roof by covering the normal e.g. wooden base used for a roof with, if desired, tar paper or other sheet backing material, and then completely covering and sealing this layer with, for example, a urethane polymer adhesive in a flowable condition. The urethane polymer adhesive is allowed to dry or cure to a tacky condition, wide rolls of polymeric sheet material, such as synthetic polymer sheet material, are applied as a top coat, and then, if necessary, rolled to provide the necessary adherence of polymeric sheet material to the adhesive undercoat. Optionally, an electrical heating grid may be disposed within or contiguous to the polymeric adhesive.

It also relates to an exposed surfacing material for concrete surfaces, and in particular for stained, chipped, cracked, pitted, and damaged concrete surfaces. A urethane or other suitable water impermeable adhesive if applied to the damaged surface in a flowable condition. Optionally, an electric heating grid may be disposed within the adhesive membrane. The polymer adhesive is allowed to dry or cure to a tacky condition and then wide rolls of polymeric sheeting material are adhered thereto. The present invention thus provides a quick and economical method for repairing damaged concrete.

The surfacing material of the instant invention may also be employed on other surfaces wherever a water-resistant surface covering is desired, such as, for example, swimming pool decks, bathrooms, recreation rooms, kitchens, entrance ways, exterior and interior wall coverings, and other uses. Additionally by choosing polymeric materials having a high tear strength and abrasion resistance, the instant surfacing material may be employed on roads, bridges, parking lots, etc.

(2) Summary of the Prior Art

Over the span of time, numerous materials have been utilized to provide roofing materials. There are many old roofing materials, such as terracotta, slate, metals, etc., however, in the present day market, asbestos shingles, tar paper, and various other materials are used for normal roofing materials. Additionally, a significant number of relatively flat roofs are made with the use of tar and gravel, etc. Each of these normal roofing methods produces a very heavy roof, and adds to the static load which must be borne by the building structure. Significantly, the calculations which are utilized to determine the strength, and thus the size, of the beams, trusses, and other components utilized in building structures must account for the weight of the proposed roofing. Therefore, it would be of great advantage to provide a roofing material which is not only easier to repair, but is lighter weight than normal roofing materials. A significant cost saving in lumber, which is now rising rapidly in price, and other building materials, could be achieved by virtue of lightening the static load that must be borne by the support structure of a building.

Additionally, roofing materials normally come in very limited color selections, and it would be a great advantage to be able to provide customers with a large selection of colors, designs, etc., which could be marketed for new or even reroofed buildings.

Some attempts have been made to providing synthetic polymeric roofing structures. However, as can be seen, in the disclosures of U.S. Pat. Nos. 3,672,951 and 3,726,754, attempts to provide such structures have included numerous layers, significant equipments expense, and as a result do not provide the advantages of significant weight reductions. Thus these products do not result in significantly lower costs for the structure, and such reductions in cost, if available, are outweighed by increased roofing expenses. In particular, U.S. Pat. No. 3,672,951 requires at least three layers with appropriate bonding material, uses foam for insulation, a separate membrane and a second insulating layer, all the fuctions of which are incorporated in the two main layers of the present invention.

In U.S. Pat. No. 3,726,754, on the other hand, again the concept of a urethane foam is utilized, and thus more layers are required which adds weight to the overall structure. The membrane in this case is on the top and thus must be resistant to actinic light to provide longevity for the roof. The present invention, by using the adhesive as the membrane eliminates this additional component and is thus less expensive and lighter.

It is also known in the prior art to provide water resistant floor coverings. In these prior art floor coverings, the surfacing material is merely unaffected by moisture and water; it does not form a water-impermeable surface which prevents water from penetrating into the underlying concrete or wooden base. For example, U.S. Pat. No. 3,410,747, discloses an outdoor type of carpeting which comprises a mesh-type backing and a flock material secured thereto. The mesh backing is impregnated with a water resistant coating to render it resistant to mildew and to the degradative effects of water. The carpet thus does not define a water impermeable surface, but rather only a carpet resistant to the degradative effects of water. Such prior art coverings allow water to permeate onto the underlying base, resulting in mildew, rot, and cracking of the base material.

Similarly, the prior art has developed methods for repairing damages concrete. Conventionally, however, this involves applying a costly concrete or asphalt cap to the surface, or even removing and replacing the existing damaged concrete.

It is also known to provide waterproofing membranes, such as described in U.S. Pat. No. 3,900,102 by using preformed rolls of flexible sheet material such as polyethylene adhered onto a waterproof adhesive. Such preformed structures are not suitable for repairing damaged concrete or reroofing old structures which often contain large cracks or uneven areas which must be filled in with an additional material before the rolls of waterproofing material can be applied.

It would be desirable therefore to provide an economical method for repairing old roofs or damaged concrete without requiring the use of an additional filler material. Additionally, it would be desirable to provide a water impermeable, light-weight surface material suitable for use as a roofing material or as a flooring covering, particularly to lower the static load factor of building structures.

SUMMARY OF THE INVENTION

Therefore the present invention has as its object the provision of a light-weight roofing structure which presents economic improvements over prior roofing structures by virtue of decreasing the building material costs.

The instant invention has as a further object providing an easy and inexpensive method of allowing much greater color and character selection for roofing structures without sacrificing the quality of the roof.

Additionally, an object of the present invention is the provision of a roof that will withstand high winds (even 100 mph) by providing a smooth surfaced roof with no exposed edges.

It is yet another object of the present invention to provide a quick, simple, and inexpensive method of providing an original roof, or reroofing old structures.

Still another object of the instant invention is the provision of a water-impermeable floor covering which can be quickly and economically installed, and which permits a large range of color and design selection.

It is a further object to provide a water-impermeable, durable, attractive covering for sidewalks, patios, terraces, shopping malls, entrance ways, driveways, bathrooms, swimming pool decks, kitchens, recreation rooms, parking lots, bridges, and roads.

The present invention also has as an object the provision of a quick, simple, and economical method of applying such a floor covering.

A further object of the invention resides in the provision of an economical means for eliminating or significantly reducing the load factor for snow and ice in building structures.

Finally, it is an additional object of the instant invention to provide a method for the quick and economical repair of damaged concrete surfaces including driveways, sidewalks, roads, parking lots and bridges.

In accomplishing the foregoing objects, there has been provided according to the present invention a surfacing material which comprises a polymeric substrate and a membrane of water impermeable pressure-sensitive material adhered onto a suitable base. In the preferred embodiment, the present invention comprises a synthetic polymeric substrate of 0.05 to 0.75 pounds per square foot, a water impermeable pressure-sensitive, preferably in situ applied, adhesive layer of a highly cross-linked polymer with a thickness of one-eighth to one-half inch, and optionally an electrical heating grid embedded in the adhesive membrane. Particularly preferred for their cross-linking ability are the polyepoxy or polyurethane adhesives.

The present invention also provides a method for the installation of the instant surface covering, which method comprises forming a smooth layer of water-impermeable polymeric adhesive on a suitable base in a flowable condition, curing the adhesive to a tacky condition, applying a sheet of synthetic polymeric material having a density from 0.05 to 0.75 pounds per square foot onto the adhesive layer, and firmly adhering the polymeric sheet onto the adhesive layer, the adhesive layer upon setting providing a water-impermeable membrane. This process may be used efficaciously for installing an original surface covering on any suitable base and as a particularly efficacious method for the repair of a damaged or leaky roof, or to repair damages concrete.

Further objects, features, and advantages of the present invention will become apparent from the drawings and the following detailed description of some preferred embodiments of the invention.

BRIEF DESCRIPTION OF THE DRAWINGS

In the Drawings:

FIG. 1 is a perspective cross-sectional view of the surface covering of the instant invention utilized as a roofing material;

FIG. 2 is an isolated cross-sectional view of a roofing structure in accordance with the present invention;

FIG. 3 is an isolated cross-sectional view of an embodiment of the present invention wherein the roofing of the present invention is applied to reroof an old roof;

FIG. 4 is a cross-sectional view of another embodiment of the present invention which includes an electric heating grid; and FIG. 5 is a cross-sectional view of an alternative embodiment of the instant invention wherein the surface covering is applied to a damaged base.

DETAILED DESCRIPTION OF PREFERRED EMBODIMENTS

In one embodiment of the present invention, there is provided a roofing structure having a normal wooden, or other overlay on building trusses or supports as its base, covered with a material comprising a water-insoluble, and, upon setting, a water-impermeable, adhesive layer. On top of the adhesive layer is applied a layer of polymeric material which is a relatively thin, yet dense polymer in the form of a sheet. The sheet may be in mat form, may be a backing material having one or more layers of woven or non-woven fibers or a nap-like material which is also a synthetic polymer, or may be in the form of a solid sheet; preferably, though, this sheet comprises a thin mat of non-woven synthetic polymer carpet of the outdoor type.

The base roofing structure may be either an old roof which has been cleaned to provide a smooth surface, or may be a normal roofing base, which normal base typically includes sheets of plywood on top of boards adjacent wooden trusses, beams, etc., sheets of plywood laid directly on trusses or beams, sheets of plywood coated with tacked-on tar paper or similar materials, or any other normal base material provided for an original roof, or a reroofing procedure.

Alternatively, in another aspect of the present invention, there is provided a water-impermeable, weather resistant surface covering which may be applied to any suitable base. In this alternative embodiment, the instant invention comprises an adhesive layer applied in situ in flowable condition, which upon curing forms a water-impermeable membrane. On top of the adhesive membrane is applied a layer of polymeric material which is again a relatively thin and light-weight, yet dense polymer in the form of a sheet. This sheet may be a woven backing material having an upper layer of a nap-like material which is also a synthetic polymer, or it may be a solid sheet of polymeric material. In the preferred embodiment, however, the upper sheet comprises a thin mat of non-woven synthetic polymer carpet of the outdoor type. The surface covering of the instant invention may be applied to any suitable base where it is desirable to have a water-impermeable, durable, yet attractive surface covering. Among the uses to which the instant invention may be applied include repairing damaged, chipped, stained or cracked concrete surfaces such as driveways, stairs, sidewalks, patios, terraces, shopping malls, and pool decks, roads, bridges, parking lots, etc. The present surface covering may also be applied as an original surface covering in any of the aforementioned uses. Additionally, the present invention finds application as a water-impermeable floor covering of the indoor-outdoor type, suitable for such uses as in bathrooms, kitchens, entrance ways, recreation rooms, or laundry areas, etc. The surface covering of the present invention may also be used as a surfacing material on roads, bridges, parking lots, airports, etc. Additionally, the present invention finds application in both exterior and interior wall coverings.

In both of the aforementioned alternative embodiments of the present invention, the adhesive layer is applied to the chosen substrate in a fluid form, either by spraying, troweling, etc. The liquid adhesive then polymerizes in situ to form the waterproof membrane. The liquid adhesive may comprise a mixture of a resin precursor which is to be polymerized and cross-linked, in combination with a cross-linking linking agent, and solvents, if desired, or by a solution or emulsion of a prepolymerized resin and a suitable cross-linking or tackifying agent. Additionally, pressure-sensitive adhesives which normally cure when exposed to the atmosphere may be used. Suitable solvents for use in the liquid adhesive include aromatic or aliphatic hydrocarbons; low molecular weight alcohols, preferably $C_2$ to $C_8$; ketones such as methyl isobutyl and methylethyl ketones; glycols such as ethylene glycol monoethyl ether; esters such as butyl acetate; or mixtures thereof. Adhesive latices, employing water as solvent, may also be used.

Any suitable tackifying agent known in the art may be employed in the liquid adhesive, provided that it is compatible with the particular polymerizable material chosen. Among those tackifiers commonly employed in adhesives are polyterpene resins, terpene-phenol resins, balsams, rosin, hydrogenated rosin, hydrocarbon resins, alkyl phenol resins, ketone resins, coumarone resins, indene resins, polyvinyl isobutyl ether, polyvinyl acetate, vinyl acetate-vinyl laurate copolymers, polyolefins, amines, and epoxy compounds. It should be noted, however, that the particular adhesive resin chosen will frequently be most compatible with only a certain tackifying agent, as is well known.

The adhesive materials employed in the instant invention may comprise any thermoplastic or thermosetting polymerizable materials. The most important characteristic of the polymeric adhesive material is that it be capable of providing a water-impermeable polymeric layer upon curing. Additionally, the polymeric material selected should be able to cross-link and adhere to diverse base materials, while also being capable of cross-linking and adhering to the upper sheet of synthetic polymeric material. Within the comtemplation of the present invention are included elastomeric adhesives such as chloroprene, butyl rubber, butadiene rubbers such as butadiene-acrylonitrile copolymers, butadiene-styrene copolymers, the carboxylated styrene-butadiene rubber of U.S. Pat. No. 3,733,242, polyisobutylene, polyvinyl esters, or mixtures of elastomers with bitumens such as described in U.S. Pat. No. 3,765,972; the acrylic, carboxylic, or glycidylic adhesive latices of U.S. Pat. No. 3,765,972; urea formaldehyde adhesives; resorcinal-formaldehyde adhesives; aminotriazine adhesives; polyvinylacetate adhesives; polysulfide adhesives; the silicon based adhesives; polyurethane adhesives; polyester adhesives; the epoxy adhesives; or mixtures thereof.

Particularly preferred are the polyepoxides and epoxides since these adhesives have an exceptionally high bond strength and stability in the presence of water. Among the epoxides or polyepoxides which may be employed are the saturated, unsaturated, aliphatic, cycloaliphatic, hetercyclic, or epoxy compounds substituted by halogen, hydroxy groups, ether radicals, etc. Exemplary of the above compounds are epoxidized glycerol dioleate, 1,4 bis(2,3-epoxypropoxy) benzene, 1,3,-bis(2,3, epoxypropoxy) benzene, 4,4'-bis(2,3-epoxypropoxy) diphenyl ether, 1,8-bis(2,3-epoxypropoxy)-octane, 1,4-bis(2,3-epoxypropoxy)cyclohexane, 4,4'-bis(2-hydroxy-3,4'-epoxybutoxy)diphenyldimethylmethane, 1,3-bis(4,5 epoxypentoxy)-5-chlorobenzene, 1,4-bis(3,4 epoxybutoxy)-2-chlorocyclohexane 1,3-bis(2 hydroxy-3,4-epoxybutoxy) benzene, 1,4 bis and (2-hydroxy-4,5 epoxypentoxy) benzene, and the epoxy polyethers of polyhydric phenols obtained by reacting a polyhydric phenol with a halogen-containing epoxide or dihalohydrin in the presence of an alkaline medium. Particularly suitable curing agents for these resins are amine compounds such as ethylene amine, ethylene diamine, propylene diamine, diethylene triamine, dipropylene triamine, triethylene tetramine, tripropylene tetramine, tetraethylene pentamine, tetrapropylene pentamine, higher alkyl polyamides, such as N-alkyl trimethylene diamines, and the poly-amido-amines disclosed in U.S. Pat. No. 3,212,946.

Particularly preferred for the purposes of this invention are the epoxy adhesives disclosed in U.S. Pat. Nos. 3,275,587; and 3,496,119 herein incorporated by reference. These patents disclose an adhesive comprising an epoxide resin and a polyamine carbamate curing agent. By employing a curing agent such as a polyamine carbamate which is activated by water to release the free amine curing agent, these resinous adhesives are particularly well suited to provide a water-impermeable membrane upon curing. Since the presence of moisture activates the curing agent, water seepage onto the water-impermeable membrane will aid in adhering the surface covering together and onto the underlying base by further cross-linking the epoxy resin, thus insuring against water permeability. For this reason, it is preferred that polyepoxides be utilized, or that epoxy materials be utilized for the cross-linking of any of the aforementioned polymers, so that cross-linking will occur as frequently as possible, and additionally so that any exposure to water will aid in adhering the surface covering together, thus aiding in the prevention of water permeability.

However, urethane resins may also be utilized. These urethanes are the resins commonly available on the market as adhesive or coating materials, and the selection of the desired urethane depends on the use desired. Exemplary urethanes are disclosed in the patents referenced above with respect to the prior art, but it is understood that blowing agents such as are needed for obtaining the foam are not to be used in the present invention, as the presence of a foam would possibly prevent the neeeded formation of the water-impermeable membrane.

Other urethane adhesives suitable for use include those based on aromatic diisocyanates and polyisocyanates such as tolylene diisocyanate, diphenylmethane diisocyanate, diphenyl- and polyphenyl-polymethylene polyisocyanates, toluene diisocyanate, 4,4'-diphenylmethane diisocyanate, 1,6-hexamethylene diisocyanate, diamidine diisocyanate, tolidine diisocyanate, 3-isocyanatomethyl-3,5,5-trimethylcyclohexylisocyanate, and w,w'-diisocyanatodimethylcyclohexane. These urethane compounds are often copolymerized with high molecular weight polyols such as polyester-ols or polyether-ols. Particularly preferred among the urethane adhesives are those described in U.S. Pat. No. 3,763,274 which discloses a water-impermeable high strength adhesive comprising (1) a polyol-arylene-diisocyanate prepolymer; (2) a prepolymer of polyester and polyurethane groups; (3) a high molecular weight saturated polyol; (4) and a difunctional amine, alcohol, or amino-alcohol curing agent such as N,N'-di sec.butyl-p-phenylenediamine, p,p'-di-2-(2-hydroxyethoxy)-diphenyl-dimethylmethane, and p,p'-di-(2-hydroxyethylamino) actachlorobiphenyl.

The adhesive compositions employed may also include other materials customarily present in structural adhesive compositions such as fillers (for example, silica powder and glass fibers) which increase the strength of the adhesive; flow promoters such as cellulose acetobutyrate; and agents which improve the resistance of the composition to water, such as gammaglycidoxypropyl trimethoxy silane, homopolymers of polyflourinated vinyl isocyanates, hydroxypolyfluoroalkylsilane derivatives, and siloxanes. Additionally, fire-retardant agents of either the organic or inorganic type well known to those skilled in the art may be incorporated into the liquid adhesives. Examples of suitable fire-retardant agents include diammonium hydrogen phosphate, polyammonium phosphate, tribromoneopentyl esters of phosphoric acids; halogenated fire-retardant agents such as chlorinated biphenyl and halogenated cyctopentadieno used conjointly with metal oxides, halogenated polymers; mixtures of halogen and phosphorus fire-retardants such as the condensation products of amines with tris-(2,3-dibromopropyl)-phosphate, mixtures of 2,3 dibromopropanol and tris-(2,3-dibromopropyl) phosphates, condensation products of bis-(carboxyethyl) phosphine oxide with halomethyl benzene; mixtures of carboxylic acid metal salts and beta-haloethylphosphate; and inorganic fire-retardants such as halogen-containing antimony oxide sols and salts of Sb(v) esters.

The thickness of the adhesive membrane of the present surface coverings can vary widely depending on the intended use. Generally, however, the thicker the layer of adhesive the better the waterproofing and insulating effect provided. Normally an adhesive membrane with a thickness of one-eighth to one-half inch is employed, and preferably of one-fourth to three-eighths inches thick. Where the present surface covering is utilized to repair damaged roofs or concrete, however, certain areas of the membrane will exceed this thickness where applied to uneven or cracked areas of the base in order to form an even layer of adhesive upon which to secure the upper sheet of polymeric material.

A heating grid may be provided in the adhesive layer adjacent either the upper sheet material or adjacent the lower base material, as desired. This grid may even be provided in the upper sheet, in a manner known in the art. The purpose of the grid is to allow selective heating of the surface covering to prevent accumulation of precipitation such as snow, sleet, etc. When a heating grid is provided in a roofing construction of the present conception, a further advantage over the prior art is obtained, decreasing the static load which must be borne by roofs in colder climates. A savings of building materials may be thereby accomplished since the structural strength of the roof need not be as great as in conventional roofing systems. The substantial safety factor for snow and ice load required in all building codes could therefore be substantially reduced.

Any of the electrical heating grids well known to the art may be employed in the present invention. Such heating grids may employ heating elements of steel, copper, aluminum or other metal, and may consist of wires, wire mats, or even sheets of metal conductor. Any line current may also be employed; however it is preferable to utilize a 220 volt source since this is most commonly available in residential use. It is also desirable to utilize a thermostat to control the output of the heating grid under changing weather conditions. Two particularly efficacious electrical heating grids are described in U.S. Pat. Nos. 2,533,409 and 3,047,701. In U.S. Pat. No. 2,533,409, strips of galvanized No. 18 hardware cloth eighteen inches wide having a one-half mesh size, and resistance of 0.0005 ohm per foot are spaced apart several inches and connected to a circuit containing a step down transformer to convert a 220 volt line current to 30 to 35 volts and to a thermostat for controlling the temperature. Such a system provides a heating current of 3600 watts to a 500 foot long heating grid, providing more than enough heat to prevent the accumulation of ice or snow, or to heat an average room. Other mesh sizes ranging from ¼ inch to 4 inches may also be employed. However, the amount of heating generated and current required will vary according to the internal resistance of the hardware cloth chosen. U.S. Pat. No. 3,047,701 describes a heating grid which comprises a mat of steel wires spaced relative to each other a distance of 3 to 10 times the distance to the top surface of the covering, and heat equalizing mats or foil which are dispersed in the surface covering in planes parallel but beneath the heating grid. Since the surface covering of the instant invention will ordinarily vary from three-eighths to three-fourths inches thick, a mat of 2 to 4 inch mesh is particularly preferred. For roofing applications, it is preferred to select the lightest material (e.g., aluminum) and the thinest gauge wire practicable in order to keep the weight of the roofing material as low as possible.

The upper sheet of polymeric material may be composed of any polymeric material which has good wear characteristics and is weather resistant. Particularly preferred are the synthetic resins which possess high durability to wear and severe weather conditions. Among the polymers suitable for use in the present invention include elastomers, polyolefins, polyamides, acrylics, polyesters, vinyl polymers, polyurethanes, polyethers, polycarbonates, polyacetals, halogenated polymers, and silicon polymers. Specific examples of suitable polymers include polytetrafluoroethylene, fluorinated ethylene-propylene, chlorotrifluoroethylene, polyvinylidene fluoride and chloride, polyvinyl chloride, polyvinyl acetate, copolymers of vinyl chloride and vinylidene chloride, polyethylene, polypropylene, polybutene, polymethyl-3-butene, polystyrene, polyhexamethylene adipamide, polycaprolactam, polyethylmethacrylate and methyl methacrylate, polyoxymethylene, hexafluoropropylene, acrylonitrile polymers, ethylene-propylene copolymers, ethylene-vinyl acetate copolymers, and terephthalate polyesters.

The polymeric upper sheet may be in the form of a smooth sheet, but is preferably a woven or non-woven mat of synthetic fibers, a backing having a nap-type surface, or a backing having a pile surface. In the preferred embodiment, however, the upper sheet comprises a synthetic mat of the indoor-outdoor carpeting type. By indoor-outdoor carpeting is meant the light-weight, relatively dense, low nap carpeting which comprises a synthetic woven or non-woven scrim to which is needle-bonded a non-woven web of synthetic fibers, typically fibers of so-called vecta polypropylene. Exemplary of such material is the indoor-outdoor carpeting marketed by the Ozite Corporation under the designations Fresh Dimension No. E2600 Series, Colony Point No. A7600 Series and Hobnail No. E1000 Series, by Armstrong under the designations Ensign No. 117, Cadet No. 122, Grade Outdoors No. 190 and Inner Action No. 134, or by GFI Corporation under the designations Gibraltor No. 9111 Series, St. Tropez No. 9101 Series or Contact I No. 9001 Series (all in order of increasing density). Products of this general type are disclosed, for example, in U.S. Pat. No. 3,924,040. Such material is particularly suited for use in the present invention for it is preferable that the upper polymeric sheet be extremely durable, relatively thick, relatively dense, light-weight and possess some resiliency. When the present surface covering is utilized as a roofing material, these qualities are particularly advantageous since such a structure has a small enough nap and has a dense enough structure to provide good water run-off, while retaining resiliency which protects the underlying substrate from damage due to rocks, falling limbs, etc.

While sheet materials of the indoor-outdoor carpeting type are preferred, and suitable sheet material may be employed in the instant invention which possesses the necessary weight, density, and durability characteristics. In this regard, also suitable for use in the instant invention are composite sheet materials such as that described in U.S. Pat. No. 3,547,772 which discloses a water-impermeable, thin, light-weight sheet material comprising outer layers of chlorinated polyolefins and an inner layer of normally crystalline polyvinylidene chloride polymer.

When the present invention is employed as a roofing material, weight is particularly critical since it is desirable that the roofing material be as light as possibel to decrease the roof structural load. The surface coverings of the present invention therefore have, in the preferred embodiment, a weight of from 0.05 to 0.75 pounds per square foot and preferably from about 0.15 to 0.40 pounds per square foot. This is in contrast to conventional roofing materials, such as standard shingles which weigh about 2.25 pounds per square foot, but vary from 1.0 to 2.5 pounds per square foot, and thus present a significant weight problem.

This weight characteristic is also critical when the surface covering of the instant invention is utilized as a wall covering, either exteriorly or interiorly. A light-weight upper polymeric sheet not only permits ease of installation, but decreases the structural load the wall must bear. Where the instant invention is employed as a surfacing material in airports, parking lots, bridges, or roads, however, it is frequently desirable to select an upper polymeric sheet with a larger weight and thickness to provide better tear and wear resistance properties. In any of these latter uses, it is preferred that the upper polymeric sheet be a heavy gauge material of the indoor-outdoor carpeting type defined above.

Any polymeric materials may thus be employed in the instant invention which possess the desired wear, density, weight, thickness, resiliency, and water repellency characteristics. Those resins used in indoor-outdoor carpeting such as any of the aforementioned polymers are preferred, however, and in particular the polyolefin polymers and copolymers are preferred such as polypropylene, etc. The upper sheet may also be coated with water repellent agents to increase the water-impermeability. Suitable water repellent agents include polytetrafluoroethylene, hydroxypolyfluoroalkylsilane derivatives, homopolymers of polyfluorinated vinyl isocyanates, the organic titanium silicon-containing compounds of U.S. Pat. No. 3,907,848, and siloxanes.

It is also necessary that the polymeric materials employed in the instant invention possess a high fire retardancy and stain resistance. Accordingly, it is desirable to incorporate any of the fire-retardant agents mentioned previously or other fire-retardants well known in the art into the upper polymer sheet. Any stain repellant known in the art may likewise be employed. Particularly useful are the polyfluoroalkyl stain repellants; the substituted polyfluoroalkyl compounds such as the alcohols, esters, and polymers thereof; polyethylene oxide terephthalate polymers, and the fluorinated stain repellants disclosed in U.S. Pat. No. 3,920,389. Preferably, however, the polyfluoroalkane marketed by the 3M Corporation under the trade name "Scotch Guard" is employed in the present invention. These additives may either be incorporated into the polymeric material utilized to produce the upper polymeric sheet, or more typically, they may be incorporated into the preformed sheet by conventional application techniques, such as dipping, spraying, rolling, brushing, etc.

PROCESS OF THE PRESENT INVENTION

The process of the instant invention will be described for ease of illustration with reference to the use of the instant invention as a roofing material. It should be clear, however, that this same process is equally applicable with minor modification to the use of the instant invention on any other suitable base, including damaged concrete. In one embodiment, therefore, a roofing base is prepared by providing a relatively smooth surface in accordance with normal procedures. These include, but are not limited to, the layering of plywood over wooden or steel trusses, the casting of a relatively smooth cement surface, the stripping of loose and worn old roofing material, and then smoothing with a putty-like material, or tar, or even the adhesive utilized at the process of the present invention. Once the relatively smooth surface is obtained, the adhesive in accordance with the aforedisclosed requirements in layered on the roof by brushing or mopping, taking care to provide an even layer from about one-eighth to one-half inch, preferably about one-quarter to three-eighths inch thick, and then rolling the sheets of the upper coating layer in accordance with the structure of the present invention over the adhesive.

If the epoxy adhesive utilized is a two-part mixture, then it is preferable that the epoxide be allowed to set sufficiently to become tacky in accordance with standard known procedures for adhering materials together, and dependent upon the nature of the mixture. Care must be exercised in this step to insure that a membrane will be formed when the adhesive sets and thus the surface should not be tampered with after the smooth layer is provided, and obviously the adhesive cannot be laid down when it is e.g. raining, or leaves are falling, etc.

The sheet mat or nap-type material is normally provided in rolls e.g. 6, 12 or 15 feet wide, and up to about 100 feet long. It is placed at the appropriate corner for starting, and then rolled out over the adhesive layer with the operators staying on the mat material, but preferably, staying both off of the mat material, and off of the adhesive-membrane material. If a material with an open mesh backing is utilized, then it is advisable to utilize a light-weight roller to insure the adhesion between the adhesive membrane layer, and the upper layer.

Upon completion of these steps, the normal steel or aluminum flashing, etc., is placed on the roof to seal around vents, chimneys, etc. Of course, as the sheet material is rolled out, the necessary cuts are made to provide close proximity to protruding objects, such as chimneys.

A capping edge is preferable, and this, of course, by standard procedures, is nailed around the edges as necessary.

In the embodiment of the present invention where mat and nap materials are utilized, these process steps are the same. However, in the embodiment where the heating grid is provided, according to one procedure, the heating grid is laid out, attached, and checked out for continuity prior to the overlay with the membrane forming adhesive. The necessary connections through or over the edge of the roof are provided, and then the amount of adhesive required is placed on the roof. It should be noted at this point, that, under these circumstances, it is preferable to provide a slightly thicker layer of adhesive in order to compensate for the thinner membrane areas between the grid portions, and the top sheet layer. Alternatively, the heating grid can be incorporated into the top sheet layer.

It should be pointed out, in particularity, that normal shingle-type roofing will not work in the process of the present invention, nor with the adhesive of the present invention, as such shingles require overlapping, and thus will not provide the smooth surface, and will not be adhered at their overlap points without subsequent nailing, and such nailing will destroy the membrane, and require the tarring procedures presently utilized in the roofing industry.

In an alternative embodiment, the process of the instant invention may be employed to provide a method for forming a surface covering of improved properties on any suitable base. In one form, the instant process provides a method for repairing a damaged base such as concrete. In another form, the instant process provides a surface covering of general utility.

Referring now to the drawings, in FIG. 1, a cross-section illustrating the use of the surface covering the present invention as a roofing material is shown. In this figure, the trusses of the roof 11 support sheets of plywood 12. This base, of course, is known in the art. Covering the sheets of plywood is a layer of tar paper 13, which has been tacked to the plywood. On top of the tar paper is the polymeric adhesive layer 14 of the present invention, and adhered to the upper side of the polymeric adhesive layer is the mat finish roofing material 15 of the present invention. The drawings are, of course, not to scale.

In FIG. 2, the same trusses, plywood and other components are not shown, as in FIG. 1, as a matter of convenience. However, a similar adhesive 14 is utilized as in FIG. 1, but in this case the provision for the tar paper has been eliminated, and a polymeric sheet roofing 16 of the indoor-outdoor carpet structure has been provided. The carpet has a non-woven web of synthetic fibers 25 needle-bonded to a woven polymeric scrim 26.

In FIG. 3, the same numerals and structures referenced above also apply, however, in this particular case, the roof is a reroofed structure wherein the old tar paper 17, hot tar 18, and standard roofing shingles 19 remain in place except where they were either broken or dislodged, and in these cases a filling material 20 which may be either further adhesive 14, or flowable filling material 21, such as a putty of other flexible material has been used. Indent 21 is a normal slit in shingle 19, and is filled with adhesive 14 in this case.

In FIG. 4, the further embodiment of the present invention very similar to that shown in FIG. 1 is provided. However, in this embodiment, an insulated electrical heating grid 22 is provided in and is covered with adhesive layer 14 prior to the provision of the roofing layer. This heating grid is connected to a thermostatic control means, not shown, which provides a means for heating the roof in the winter, as necessary, to prevent accumulations of ice, sleet, snow, etc. These heating grids provide an added capability of static load reduction, and thus provide a further economic advantage.

FIG. 5 illustrates an alternative embodiment of the present invention in which the surface covering is applied as a durable covering to a damaged base 23 such as cracked or pitted concrete. Filling material 20, which may be an additional flowable filling material, but preferably is additional water-impermeable adhesive 14, is applied to the cracks or pitted areas of base 23 to provide a smooth surface. Adhesive 14 is then further applied to form an even water-impermeable membrane which has a thickness from about one-eighth to one-half inch and preferably about one-fourth to three-eighths inch thick. An upper polymeric sheet 24 of heavy grade indoor-outdoor carpeting is then adhered to the tacky adhesive. Upon curing, a repaired concrete surface is produced with an attractive and economical covering. An electric heating grid 22 may also be employed in this embodiment, in the manner illustrated wherein the grid is embedded in the upper sheet 24.

It should be obvious, however, that the surface covering of FIG. 5 may be applied as a surface covering of general utility whenever an attractive, durable, water-impermeable surface covering is desired, for example, on sidewalks or road surfaces on bridges. In the latter case, the provision of the aforesaid heating grid has the particular advantage that freezing conditions on bridges can be eliminated, thereby eliminating one very serious source of traffic accidents.

What is claimed is:

1. A water-impermeable, weather resistant, lightweight structural surface for use in static structures, consisting of:

a. a structural base surface comprising a supported material selected from the group consisting of wood, metal, and concrete;

b. a layer of water-impermeable epoxy adhesive utilizing a water-activable curing agent, having a thickness of from about one-eighth to one-half inches disposed adjacent to said base surface and being directly adhered thereto, said adhesive layer having been applied in a flowable condition whereby a generally smooth top surface of the adhesive layer is produced;

c. a light-weight electrical heating grid incorporated into said water-impermeable layer; and d. an upper layer of indoor-outdoor carpeting adhered to the top surface of said water-impermeable adhesive layer, said upper layer comprising a low-nap, non-woven, relatively thick web of polyolefin polymer or copolymer fibers having a thickness such as to provide a web with a weight of from about 0.05 to 0.75 pounds per square foot, and functioning as a relatively thick protective covering layer for said adhesive layer.

2. The structural surface of claim 1, wherein said adhesive layer has a thickness of from about one-fourth to about three-eighths inches.

3. The structural surface of claim 1, wherein said upper layer of indoor-outdoor carpeting has a weight of from about 0.15 to 0.40 pounds per square foot.

4. The structural surface of claim 1, wherein said upper layer of indoor-outdoor carpeting is treated with a chemical agent selected from the group consisting of stain repellant agents, fire-retardant agents, water-repellant agents, and combinations thereof.

5. The structural surface of claim 1, wherein said structural surface comprises a roof.

6. The structural surface of claim 1, wherein said structural surface comprises a wall.

* * * * *